United States Patent [19]

Meeks

[11] 4,138,742

[45] Feb. 13, 1979

[54] CONVERTIBLE CUSHION

[76] Inventor: Dwight S. Meeks, 470 Fairview Rd. SW., Camden, Ark. 71701

[21] Appl. No.: 848,481

[22] Filed: Nov. 4, 1977

Related U.S. Application Data

[63] Continuation-in-part of Ser. No. 650,617, Jan. 20, 1976, Pat. No. 4,060,852.

[51] Int. Cl.[2] ..... A41D 9/00

[52] U.S. Cl. ..... 2/84

[58] Field of Search ..... 2/84, 93, 69, 69.5, 2/85, 86, 87, 89, 94, 96, 243 R; 150/52 R, 2.1, 2.2, 2.3, 2.4

[56] References Cited

U.S. PATENT DOCUMENTS

| | | | |
|---|---|---|---|
| 3,228,034 | 1/1966 | Grove | 2/69.3 |
| 3,835,471 | 9/1974 | Lankford | 2/84 |

*Primary Examiner*—Werner H. Schroeder
*Assistant Examiner*—Doris L. Troutman
*Attorney, Agent, or Firm*—John M. Harrison

[57] ABSTRACT

A convertible cushion characterized by a cushion pad and a stylish or protective foul or cold weather garment which is attached to and can be folded in cooperation with the cushion pad to be used in conventional manner as a cushion, and which can also be unfolded from the cushion pad and used in bad or cold weather with the cushion pad functioning as a seating pad.

10 Claims, 10 Drawing Figures

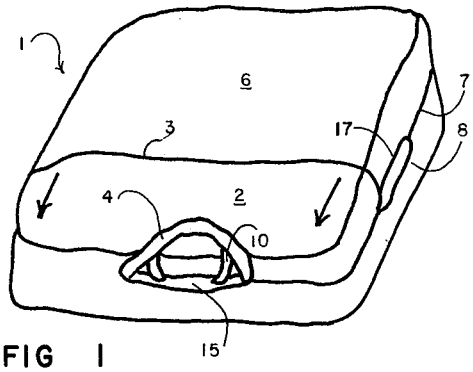
FIG 1
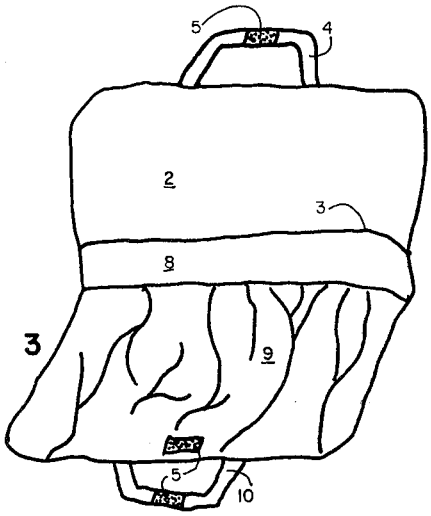
FIG 3
FIG 2
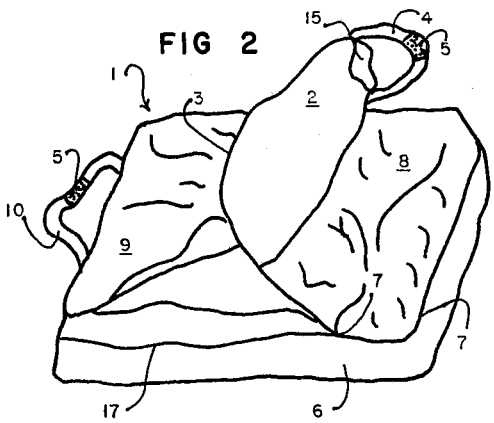
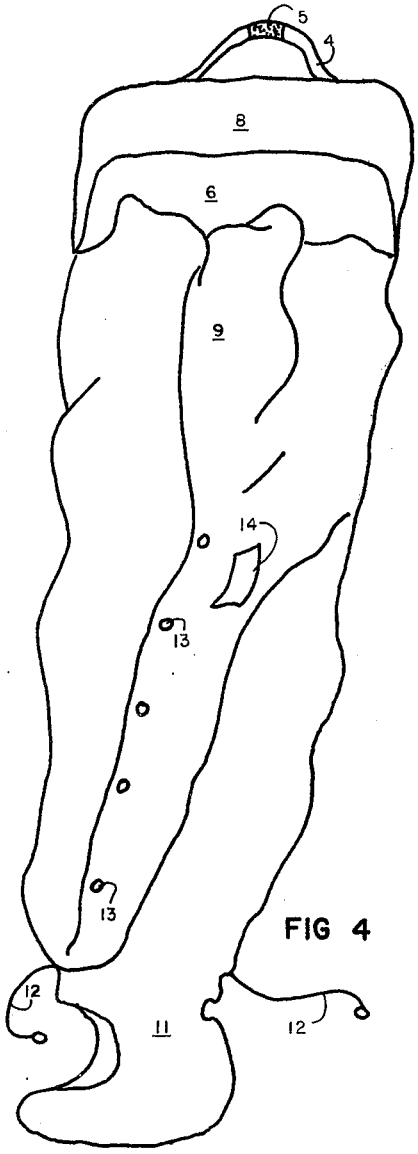
FIG 4
FIG 5
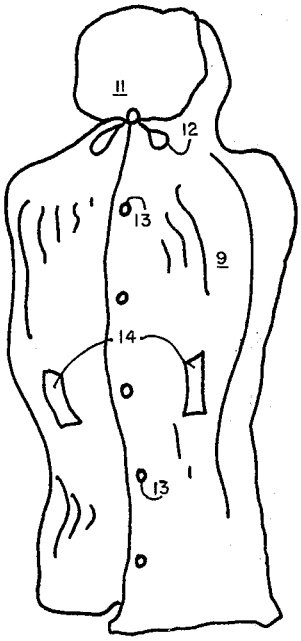
FIG 6
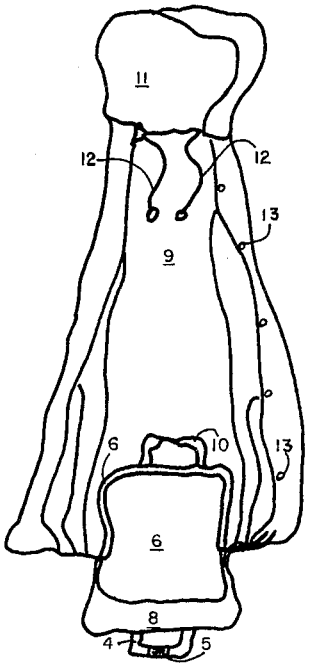

CONVERTIBLE CUSHION

BACKGROUND OF THE INVENTION

Cross References to Related Applications

This application is a continuation-in-part of copending application Ser. No. 650,617, filed Jan. 20, 1976, now U.S. Pat. No. 4,060,852 patented Dec. 6, 1977.

Field of the Invention

This invention relates to a stylish or protective garment, and particularly, to a foul weather garment which is attached to a seat cushion pad and which is capable of being folded in cooperation with the cushion pad when not worn. The protective garment is designed to protect the wearer from rain, sleet, snow, wind, and cold, and may be optionally interiorly lined and fitted with a hood, as desired. When removed from folded configuration with respect to the cushion pad, the garment can be worn as any conventional stylish, foul or cold weather garment, with the attached cushion pad positioned in the rear of the garment and functioning as a seating pad when the wearer is seated. In a preferred embodiment of the invention, the protective garment and cushion pad are designed to be folded inside a pocket and cooperating cover panel carried by the garment, with the garment positioned on one side of the attached cushion pad, to provide a cushion for seating during such activities as viewing television, picnics, boating, good weather viewing of football or baseball games, and other indoor and outdoor use.

Description of the Prior Art

Heretofore, foul weather suits and other protective garments such as slicker suits, rain parkas and ponchos have been typically stored and carried in a separate small plastic container or roller into a tight bundle when not in use. Some designs have included folding the garment body into the hood or other area of the garment to avoid using such a container or carrier. Typical of such prior art protective garments is the convertible cushion disclosed in U.S. Pat. No. 2,462,269 to A. W. Krempel, which illustrates the use of a foul weather rain cape having a hood which also serves as a carrier for the cape. The cape is folded into the interior of the hood when not in use. Similarly, U.S. Pat. No. 2,971,198 to M. M. Tomich discloses a rain cape having a hood which serves to receive the folded cape when the latter is not in use. The folded hood is zipped to form a convenient carrying bag after the cape is tucked inside.

Accordingly, it is an object of this invention to provide a convertible cushion which is characterized by a cushion pad and an attached stylish, cold or foul weather garment or alternative protective garment, which cushion pad is attached to the rear of the garment, and when the garment is unfolded and worn, is designed to function as a built-in pad or cushion for seating purposes.

Another object of the invention is to provide a combination seat cushion or pad and attached stylish or protective foul or cold weather garment which can be alternatively folded with the cushion inside a pocket and cover panel carried by the garment, which pocket and cover panel locate the garment alongside the cushion, and which garment can be subsequently unfolded and slipped on with the cushion remaining attached to the garment at all times.

Yet another object of the invention is to provide a padded seat cushion and stylish or protective garment combination, which garment can be removably attached to the cushion and used either with the cushion in place or without the cushion, as desired.

A still further object of the invention is to provide a combination cushion pad and attached stylish or protective foul or cold weather garment, which garment can be manufactured of thin plastic or nylon and used as a rain repellant covering, or of heavier materials and used as a cold weather coat or poncho, and which may also be equipped with a hood, the cushion pad of which is capable of being folded into a pocket-cover panel combination along with the garment, without the necessity of using a zipper or other closure to secure the garment and pad inside the pocket and cover panel.

Another object of the invention is the provision of a convertible cushion which is capable of being used as a light weight pad in good weather and which contains a cushion pad and a foul weather garment folded alongside and attached to the cushion pad in a pocket attached to the garment, without the necessity of using closures to secure the garment and cushion pad in folded configuration.

Yet another object of the invention is to provide a padded convertible cushion which carries a protective garment and a cushion pad sewn into a pocket in the inside rear of the garment, which garment and cushion can be easily folded in a cover panel pocket, and unfolded from the pocket and worn with the cushion pad attached to the garment and positioned to the rear of, and below the wearer's waist to provide a built-in pad for seating comfort.

A still further object of the invention is to provide a convertible cushion equipped with a cushion pad and an attached foul weather garment which are both folded into a pocket and cover panel flap to position the garment on one side of the cushion pad when not in use, and which may be unfolded and worn during foul weather, with the cushion pad preferably sewn into the rear of the garment and deployed to act as a seat pad for the wearer.

SUMMARY OF THE INVENTION

These and other objects of the invention are provided in a convertible cushion characterized by a cushion pad attached to a stylish foul or cold weather protective garment, which garment is capable of being folded in a cover panel pocket alongside the cushion pad and used in conventional fashion as a pad for seating purposes, and removed from folded configuration and worn with the cushion pad again serving as a built-in pad for seating. The garment and cushion pad are folded in a pocket and cover panel attached to the bottom of the garment, and are easily secured inside the pocket and cover panel without the necessity of using zippers, buttons or other closure means.

BRIEF DESCRIPTION OF THE DRAWING

The invention will be better understood in view of the following description presented with reference to the accompanying drawings:

FIG. 1 of the drawings is a perspective view of the convertible cushion of this invention, including a cushion pad with a stylish foul or cold weather garment folded in cooperation with the cushion pad;

FIG. 2 is a side perspective view of the convertible cushion illustrated in FIG. 1 with the carrying pocket and cover panel partially folded away from the protective garment and cushion pad to permit unfolding of the garment;

FIG. 3 is a front perspective view of the convertible cushion and garment illustrated in FIGS. 1 and 2, more particularly illustrating a preferred technique of unfolding the garment and cushion pad from the carrying pocket and cover panel;

FIG. 4 is a perspective view of the convertible cushion and protective garment illustrated in FIGS. 1–3, more particularly showing outfolding of the upper and middle portions of the protective garment from the carrying pocket and cover panel and away from the attached cushion pad;

FIG. 5 is a front perspective view of the protective garment fully unfolded from the pocket and cover panel and in wearing configuration;

FIG. 6 is a front perspective view of the protective garment illustrated in FIG. 5 in open configuration to more particularly illustrate a preferred positioning of the attached cushion pad;

DESCRIPTION OF THE PREFERRED EMBODIMENTS

Figure 7:
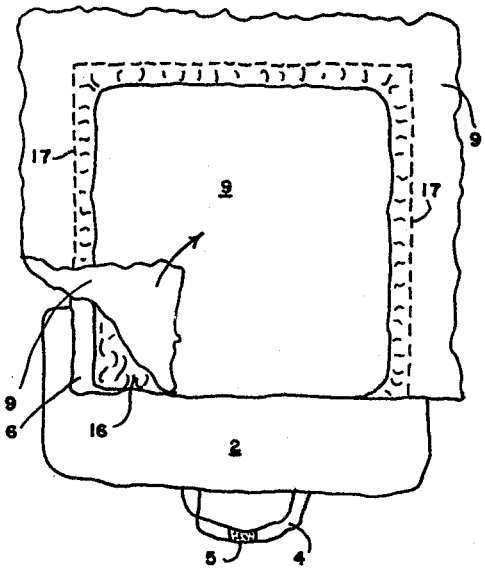
FIG. 7 of the drawings is a front view, partially in section, of the protective garment viewed from the outside rear and illustrating a preferred position of the cushion pad as sewn on or otherwise attached to the protective garment.

Referring now to FIGS. 1–3 and 7 of the drawing, the convertible cushion of this invention is generally illustrated by reference numeral 1 and is characterized by protective garment 9 and cushion pad pocket 6, the latter of which, in a preferred embodiment, is sewn onto the lower inside rear portion of protective garment 9 to contain cushion pad 16, as illustrated in FIG. 7. Convertible cushion 1 also includes pocket 2, formed in cover panel 8 and designed to carry protective garment 9 folded therein. Pocket 2 and cover panel 8 are attached to protective garment 9 on both sides of, and spanning cushion 16 along cover panel seam 7, as hereinafter described, and are fashioned to hang below cushion pad pocket 6 and cushion pad 16 when protective garment 9 is unfolded and worn, as illustrated in FIG. 6 of the drawing. Pocket lip 3 on pocket 2 is designed to fold over the top or carrying end of cushion pad 6 to enclosed protective garment 9 inside pocket 2 and cover panel 8. Pocket handle 4 is attached to pocket 2 and spans pocket aperture 15 (illustrated in FIGS. 1 and 2), through which cushion handle 10, which is attached to cushion pad pocket 6, projects when protective garment 9 is folded in the interior of pocket 2 and cover panel 8, as illustrated in FIG. 1 of the drawing. Cooperating loop pile fasteners 5, attached to pocket handle 4 and cushion handle 10, serve to removably join pocket handle 4 and cushion handle 10 to permit convenient carrying of convertible cushion 1 when protective garment 9 is in folded configuration as illustrated in FIG. 1.

Referring now to FIGS. 1–4 of the drawing, when it is desired to remove protective garment 9 from pocket 2 and cover panel 8, pocket lip 3 is initially folded rearwardly in the direction of the arrows, as illustrated in FIG. 1. Convertible cushion 1 is then turned over, loop pile fasteners 5 on pocket handle 4 and cushion handle 10 are disengaged, cushion handle 10 is pulled through pocket aperture 15, and pocket 2 is folded away from protective garment 9, as illustrated in FIGS. 2 and 3. This action permits protective garment 9 to be freely opened and unfolded as illustrated in FIG. 4 of the drawing.

Referring now to FIGS. 5 and 6 of the drawing, it will be appreciated that protective garment 9 can be optionally equipped with a garment hood 11 and accompanying draw strings 12 to permit garment hood 11 to be closely drawn around the face of a wearer. Protective garment 9 may also be fitted with closures 13, which are typically buttons, snaps or the like, to secure the garment around the wearer. Furthermore, arm slots 14 are preferably provided to permit use of the hands and arms while wearing protective garment 9; in the alternative, sleeves may be included on protective garment 9, as desired. Referring particularly to FIG. 6 of the drawing, and as heretofore described, it will be appreciated that cushion pad pocket 6 is positioned on the rear inside portion of protective garment 9, well below the waist of the user. This positions it and cushion pad 16, sewn between protective garment 9 and cushion pad pocket 6 or otherwise attached to protective garment 9, in proper configuration immediately beneath a wearer when the wearer is seated. It is significant that cushion pad pocket 6 and cushion pad 16 must be positioned lower on protective garment 9 than would ordinarily be expected by simple visual location, because of the curvature of the user's body while in seated position. Such positioning of cushion pad pocket 6 and cushion pad 16 will insure that the latter is located directly beneath the wearer while he is in seated position.

Figure 8:
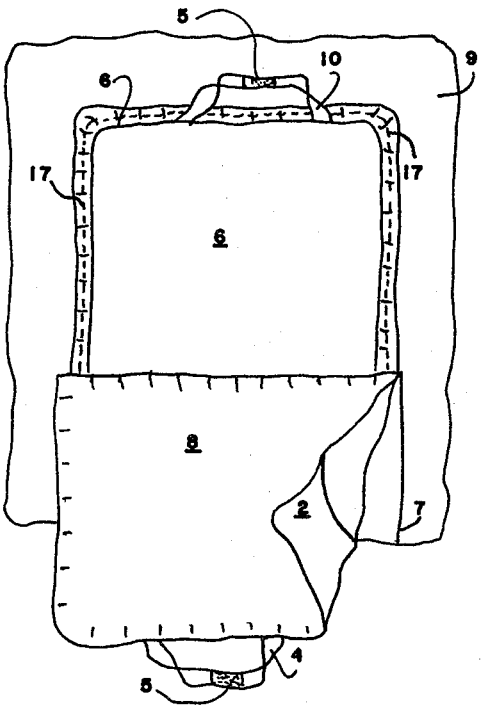
FIG. 8 is a front view, partially in section, of the opposite side of the protective garment and cushion pad illustrated in FIG. 7, and viewed from the inside rear.

Referring now to FIGS. 7 and 8 of the drawing, viewing convertible cushion 1 from the outside rear, as heretofore described, in a preferred embodiment of the invention cushion pad 16 is sewn between cushion pad pocket 6 and protective garment 9 along cushion pad pocket seam 17. After cushion pad 16 is so attached to protective garment 9, cover panel 8, with pocket 2 attached, is sewn onto protective garment 9 and cushion pad pocket 6 along cover panel seam 7, which is substantially coexistent with cushion pad pocket seam 17 along the lower segment of cushion pad pocket 6 and protective garment 9, as illustrated in FIGS. 1, 2, and 8 of the drawing.

Figure 9:
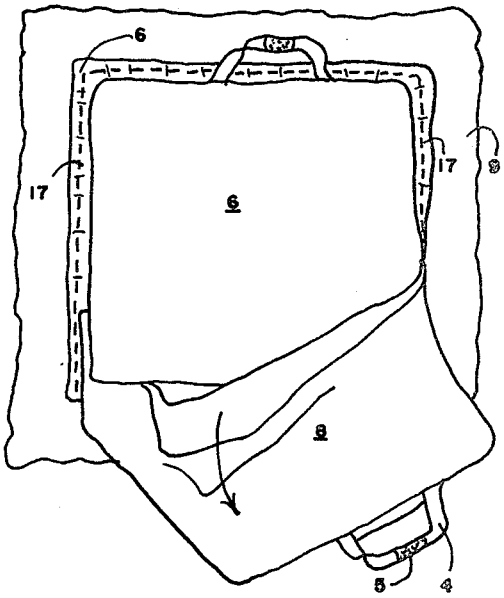
FIG. 9 is a front view, partially in section, of the protective garment and cushion pad illustrated in FIG. 8, further illustrating a preferred folding of the cover panel behind the cushion pad as viewed to permit the protective garment to be folded inside the cover panel and pocket.
Figure 10:
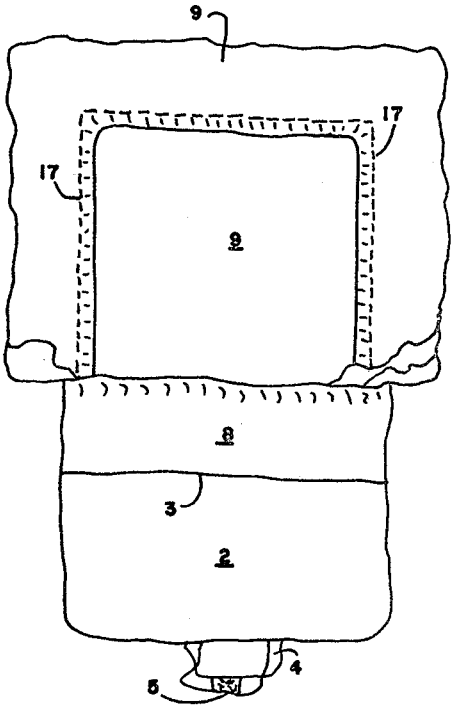
FIG. 10 is a front view, partially in section, of the protective garment illustrated in FIG. 7, with the cover panel folded behind the cushion pad in position whereby the protective garment can be easily folded inside the cover panel and pocket.

Referring now to FIGS. 9 and 10 of the drawing, in order to position pocket 2 and cover panel 8 in configuration to receive protective garment 9 as illustrated in FIG. 1, cover panel 8 is folded from the position illustrated in FIG. 8 behind cushion pad 16 and cushion pad pocket 6 as shown in FIG. 9, to the configuration illustrated in FIG. 10. This folding of cover panel 8 and the attached pocket 2 tucks the bottom hem line of protective garment 9 adjacent cushion pad pocket 6 and cushion pad 16 inside cover panel 8 and permits easy folding and unfolding the body of protective garment 9 inside cover panel 8 and pocket 2, as illustrated in FIGS. 1–4 of the drawing.

It will be appreciated by those skilled in the art that the convertible cushion of this invention is characterized by both convenience and flexibility, in that it is capable of use both in folded and unfolded configuration, as heretofore described. Furthermore, the protective garment can be designed in conventional sizes and shapes, and a cushion pad of desired size and thickness used in cooperation with the garment, as disclosed herein. The convertible cushion is particularly well suited for football games and other outdoor athletic contests, as well as fishing and hunting trips, where the viewer is exposed to the weather. As heretofore described, while it is preferred to sew the cushion pad on the protective garment, it will be appreciated by those skilled in the art that the cushion pad can be removably attached to the garment by appropriate means such as zippers, snaps or the like, as desired.

Accordingly, having described my invention with the particularity set forth above, what is claimed is:

1. A convertible cushion comprising:
(a) a protective garment;
(b) a cushion pad attached to the inside rear portion of said protective garment with one end of said cushion pad substantially coextensive with the bottom hem line of said protective garment;
(c) a cover panel spanning the width of said cushion pad and attached to said protective garment along said bottom hem line and on each side of said cushion pad in substantially perpendicular relationship to said bottom hem line; and
(d) a pocket formed in said cover panel to permit said protective garment to be folded between said cover panel and said cushion pad, and said pocket to be folded over said protective garment and over the end of said cushion pad opposite said one end to removably secure said protective garment between said cushion pad and said cover panel.

2. The convertible cushion of claim 1 further including a cushion handle and a pocket handle attached to said cushion pad and said cover panel, respectively, to facilitate carrying said convertible cushion when said protective garment is folded between said cover panel and said cushion pad.

3. The convertible cushion of claim 1 wherein said cushion pad is carried in a cushion pad pocket sewn to said protective garment and said protective garment is provided with a hood.

4. The convertible cushion of claim 1 wherein said cushion pad is carried in a cushion pad pocket sewn to said protective garment, said protective garment is provided with a hood, and further including a cushion handle and a pocket handle attached to said cushion pad pocket and said cover panel, respectively, to facilitate carrying said convertible cushion when said protective garment is folded between said cover panel and said cushion pad.

5. The convertible cushion of claim 1 wherein said protective garment is provided with sleeves.

6. The convertible cushion of claim 1 wherein said protective garment is provided with arm slots.

7. The convertible cushion of claim 1 wherein said protective garment is provided with closure means on the mating edges thereof to secure said protective garment on and around a wearer.

8. The convertible cushion of claim 1 wherein said cushion pad is carried in a cushion pad pocket sewn to said protective garment; said protective garment is provided with a hood; and said protective garment is provided with arm slots and closure means on the mating edges thereof to secure said protective garment on and around a wearer; and further including a cushion handle and a pocket handle attached to said cushion pad pocket and said cover panel, respectively, to facilitate carrying said convertible cushion when said protective garment is folded between said cover panel and said cushion pad.

9. The convertible cushion of claim 2 further including an aperture in said pocket along the seam joining said pocket and said cover panel, and loop pile fasteners attached to the top portion of said cushion handle and the bottom portion of said pocket handle to join said cushion handle to said pocket handle when said cushion handle is pulled through said aperture.

10. The convertible cushion of claim 1 wherein said cushion pad is carried in a cushion pad pocket sewn to said protective garment; said protective garment is provided with a hood, and arm slots and closure means on the mating edges thereof to secure said protective garment on a wearer; and further including:
(a) a cushion handle and a pocket handle attached to said cushion pad pocket and said cover panel, respectively, to facilitate carrying said convertible cushion when said protective garment is folded between said cover panel and said cushion pad;
(b) an aperture in said pocket along the seam joining said pocket and said cover panel; and
(c) loop pile fasteners attached to the top portion of said cushion handle and the bottom portion of said pocket handle to join said cushion handle to said pocket handle when said cushion handle is pulled through said aperture.

* * * * *